US009722373B2

(12) United States Patent
Ejiri et al.

(10) Patent No.: US 9,722,373 B2
(45) Date of Patent: Aug. 1, 2017

(54) INSERTION PLUG

(71) Applicant: SMK Corporation, Tokyo (JP)

(72) Inventors: Koichiro Ejiri, Kanagawa (JP); Haruhiko Kondo, Kanagawa (JP); Rie Abe, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/335,443

(22) Filed: Oct. 27, 2016

(65) Prior Publication Data

US 2017/0125957 A1 May 4, 2017

(30) Foreign Application Priority Data

Oct. 29, 2015 (JP) ..... 2015-212457

(51) Int. Cl.
*H01R 29/00* (2006.01)
*H01R 27/00* (2006.01)
*H01R 13/05* (2006.01)

(52) U.S. Cl.
CPC ..... *H01R 27/00* (2013.01); *H01R 13/05* (2013.01)

(58) Field of Classification Search
CPC .... H01R 29/00; H01R 27/00; H01R 2103/00; H01R 31/06; H01R 31/065; H01R 13/6675; H01R 35/00
USPC ..... 439/173, 171, 174, 956
See application file for complete search history.

(56) References Cited

U.S. PATENT DOCUMENTS 1,498,146 A * 6/1924 Benjamin ..... H01R 27/00 439/173
2,417,928 A * 3/1947 Guernsey ..... H01R 27/00 439/173
2,584,476 A * 2/1952 Liaci ..... H01R 4/2404 439/418
2,879,494 A * 3/1959 Teetor ..... H01R 13/44 439/134
3,129,989 A * 4/1964 Myers ..... H01R 35/00 116/303
3,474,376 A * 10/1969 Preiss ..... H01R 13/56 439/171
3,497,850 A * 2/1970 Gallo, Sr. ..... H01R 31/00 337/197
3,838,385 A * 9/1974 Bloomingdale ..... H01R 13/44 439/135

(Continued)

FOREIGN PATENT DOCUMENTS

JP 2000-12174 A 1/2000

*Primary Examiner* — Abdullah Riyami
*Assistant Examiner* — Vladimir Imas

(57) ABSTRACT

An insertion plug includes:

a rotor fixed around a blade, and housed in an insulating plug case;

a guide unit in the insulating plug case to guide the rotor around an axis extending in a longitudinal direction of the blade and within a rotation angle of at least 90 degrees between a first rotation position at which the blade becomes substantially parallel with another blade and a second rotation position at which the blade becomes substantially orthogonal to the other blade; and a positioning unit that positions the rotor at the first rotation position or the second rotation position, the blades caused to project from a position corresponding to an AC power source outlet if the rotor is positioned at the first rotation position, and the blades caused to project from a position corresponding to a DC power source outlet if the rotor is positioned at the second rotation position.

4 Claims, 7 Drawing Sheets

(56) References Cited

U.S. PATENT DOCUMENTS

| | | | | | |
|---|---|---|---|---|---|
| 4,317,424 | A * | 3/1982 | Steadman | F16D 43/216 | 116/294 |
| 4,944,697 | A * | 7/1990 | Dorman | H01H 85/0417 | 337/255 |
| 5,106,317 | A * | 4/1992 | Taylor | H01R 31/06 | 439/173 |
| 5,159,545 | A * | 10/1992 | Lee | H02M 5/12 | 363/146 |
| 6,454,578 | B1 * | 9/2002 | Yao | H01R 35/04 | 320/111 |
| 6,780,034 | B2 * | 8/2004 | Shiroshita | H01R 31/06 | 439/174 |
| 7,052,298 | B1 * | 5/2006 | Cheng | H01R 13/6675 | 439/103 |
| 7,303,416 | B1 * | 12/2007 | Liao | H01R 13/633 | 439/173 |
| 7,306,471 | B2 * | 12/2007 | Shau-din | H01R 24/28 | 439/104 |
| 7,604,492 | B1 * | 10/2009 | Wang | H01R 24/30 | 439/131 |
| 8,043,100 | B2 * | 10/2011 | Liao | H01R 27/00 | 439/131 |
| 8,197,273 | B1 * | 6/2012 | Lee | H01R 13/514 | 439/172 |
| 8,366,461 | B2 * | 2/2013 | Lee | H01R 24/30 | 439/131 |
| 8,734,168 | B2 * | 5/2014 | Lee | H01R 13/4534 | 439/171 |
| 8,790,124 | B2 * | 7/2014 | Lee | H01R 31/06 | 439/131 |
| 9,059,547 | B2 * | 6/2015 | McLawhorn | A61B 18/14 | |
| 9,077,093 | B1 * | 7/2015 | Roy | H02K 49/10 | |

* cited by examiner

INSERTION PLUG

The contents of the following Japanese patent application are incorporated herein by reference:

No. 2015-212457 filed on Oct. 29, 2015.

BACKGROUND

1. Technical Field

The present invention relates to an insertion plug to be connected to an outlet connected to a power source power source by inserting a pair of blades to the outlet, and more particularly, relates to an insertion plug that can be inserted to both a DC power source outlet connected to a commercial use DC power source and an AC power source outlet connected to a commercial use AC power source.

2. Related Art

Because recently internal operations of many appliances are performed by using DC, it has been considered to adopt DC power sources as power sources for domestic power distribution in order to eliminate waste of electrical power consumption by AC electric supply. Because in a pair of power source lines that distribute power from an AC power source, simply a relative AC voltage is generated between the pair of power source lines, there are no polarities between a pair of terminals of an AC power source outlet connected to a commercial use AC power source, and accordingly no matter to which terminal one blade among a pair of blades of the insertion plug is inserted, such a connection never becomes an erroneous connection, and a pair of terminals of a conventional AC power source outlet have the same shape and are arranged in parallel. On the other hand, one of a pair of power source lines that distributes power from a DC power source is at a ground potential, and the other one is at a potential of a DC voltage, the pair of power source lines have polarities, and a pair of terminals of a DC power source outlet are arranged being oriented to be mutually orthogonal so that one does not insert a pair of blades of an insertion plug that have different polarities erroneously.

Because in earlier stages of the spread of DC electric supply, there are both AC electric supplies and DC electric supplies, there are also two types of appliance that operate with either AC power sources or DC power sources. Therefore, as shown in FIG. 7, a complex outlet 100 to which two types of outlet, that is, an AC power source outlet 101 and a DC power source outlet 102 are provided has been proposed in Patent Document 1 so that any appliance can be used. In this complex outlet 100, a power source line connected to an AC power source is connected to the AC power source outlet 101, and a predetermined DC voltage obtained after smoothing and rectification of an AC power source and then performing DC-DC conversion thereon is applied to a pair of terminals of the DC power source outlet 102.

PRIOR ART DOCUMENT

Patent Document

[Patent Document 1] Japanese Patent Application Publication No. 2000-12174

Because even if the conventional complex outlet 100 is used, arrangements of pairs of terminals are different between the AC power source outlet 101 and the DC power source outlet 102, it is necessary to prepare, at terminals of power source cords of two types of appliance that operate with an AC power source and a DC power source, respectively, two types of insertion plug which are an insertion plug that can be inserted to the AC power source outlet 101 and an insertion plug that can be inserted to the DC power source outlet 102.

Also, because the complex outlet 100 in which two types of outlet, that is, the outlets 101, 102, are arranged has an external shape different from the conventional AC power source outlet 101 used for a commercial use AC power source, it has not been easy to replace the AC power source outlet 101 embedded in a wall or the like with the complex outlet 100.

Also, if a conventional AC electric supply system is to be switched to a DC electric supply system, an AC power source outlet can be used as a DC power source outlet without replacing a pair of AC power source lines wired in a house, simply by performing AC-DC conversion on a commercial use AC power source drawn into a house. However, as mentioned above, because arrangements of pairs of terminals are different between an AC power source outlet and a DC power source outlet, an appliance cannot be caused to operate by inserting a DC insertion plug connected to a power source cord of the appliance that operates with a DC power source. Eventually, it is not possible to use an appliance that operates with a DC power source until a DC power source outlet is replaced with an AC power source outlet.

The present invention has been made in view of the above drawbacks accompanying the related art, and it is an object of the present invention to provide an insertion plug that can singly support both an AC electric supply and a DC electric supply without preparing two types of insertion plug to be connected to a power source cord of an appliance.

Also, it is an object of the present invention to provide an insertion plug that can cause an appliance to operate by inserting the insertion plug to connect to a power source cord of the appliance that operates with a DC power source, without replacing a conventional AC power source outlet with a DC power source outlet.

SUMMARY

In order to achieve the above-mentioned objects, in an insertion plug according to a first aspect of the present invention with at least a pair of one blade and another blade to: connect to a terminal of a power source cord; project from a connection surface of an insulating plug case; and be inserted to an outlet connected to a power source, thereby establishing a connection between the power source cord and the power source, the insertion plug includes:

a rotor fixed around the one blade, and housed freely revolvably in the insulating plug case;

a guide unit that: is provided in the insulating plug case; and guides the rotor freely revolvably around an axis that extends in a longitudinal direction of the one blade and within a rotation angle of at least 90 degrees or larger between a first rotation position at which the one blade becomes parallel with the other blade and a second rotation position at which the one blade becomes orthogonal to the other blade; and a positioning unit that positions, at the first rotation position or the second rotation position, the rotor that revolves between the first rotation position and the second rotation position, wherein if the rotor is positioned at the first rotation position, the one blade and the other blade are caused to project from a position of the connection surface at which the one blade and the other blade are freely insertable to an AC power source outlet to connect to a commercial use AC power source, and if the rotor is positioned at the second rotation position, the one blade and the other blade are caused to project from a position of the connection surface at which the one blade and the other blade are freely insertable to a DC power source outlet to connect to a commercial use DC power source.

If the rotor fixed to the one blade is revolved to the first rotation position and positioned by the positioning unit, the pair of blades project from the connection surface in parallel with each other, and becomes freely insertable to an AC power source outlet. If the rotor fixed to the one blade is revolved to the second rotation position and positioned by the positioning unit, the pair of blades project from the connection surface while being orthogonal to each other, and become freely insertable to a DC power source outlet. Accordingly, the single insertion plug can be connected with power source outlets for both AC and DC.

In an insertion plug according to a second aspect of the present invention, the one blade is connected to a ground-side power source cord.

The one blade that revolves the rotor is at a ground potential.

In an insertion plug according to a third aspect of the present invention, the positioning unit has:

a first ferromagnetic body fixed to an outer side surface of the rotor; and a second ferromagnetic body that is fixed to the guide unit in an area facing the first ferromagnetic body between the first rotation position and the second rotation position of the rotor, and is attracted by the first ferromagnetic body.

When the rotor is at the first rotation position or the second rotation position, the first ferromagnetic body and the second ferromagnetic body attract each other, and the rotor is positioned at the first rotation position or the second rotation position.

In an insertion plug according to a fourth aspect of the present invention, the positioning unit has:

a fixing unit that fixes revolution of the rotor selectively at either the first rotation position or the second rotation position; and a release unit that releases the fixation by the fixing unit.

The revolution of the rotor is fixed selectively at either the first rotation position or the second rotation position by the fixing unit, and the fixation is released by the release unit.

According to the first aspect of the present invention, an insertion plug can singly support both an AC electric supply and a DC electric supply without preparing two types of insertion plug to connect to a power source cord of an appliance.

Also, while still using an AC power source outlet to connect to a power source line converted from an AC electric supply to a DC electric supply, an appliance that operates with a DC power source can be caused to operate by inserting, to the AC power source outlet, the insertion plug connected to a power source cord of the appliance.

According to the second aspect of the present invention, because the one blade fixed to the rotor is at a ground potential, there is no risk of electric shocks if the rotor is revolved by holding a blade.

According to the third aspect of the present invention, even if the rotor revolves, a power source cord connected to the one blade is twisted, and a torque is generated to the rotor in a direction to reverse the twist of the power source cord, the rotor is positioned at the first rotation position or the second rotation position, and the one blade is not rotated unintentionally.

According to the fourth aspect of the present invention, because the rotor does not revolve from the first rotation position or the second rotation position unless the fixation by the fixing unit is intentionally released by the release unit, the orientation of the one blade relative to the other blade is not unintentionally changed.

DESCRIPTION OF EXEMPLARY EMBODIMENTS

Figure 1:
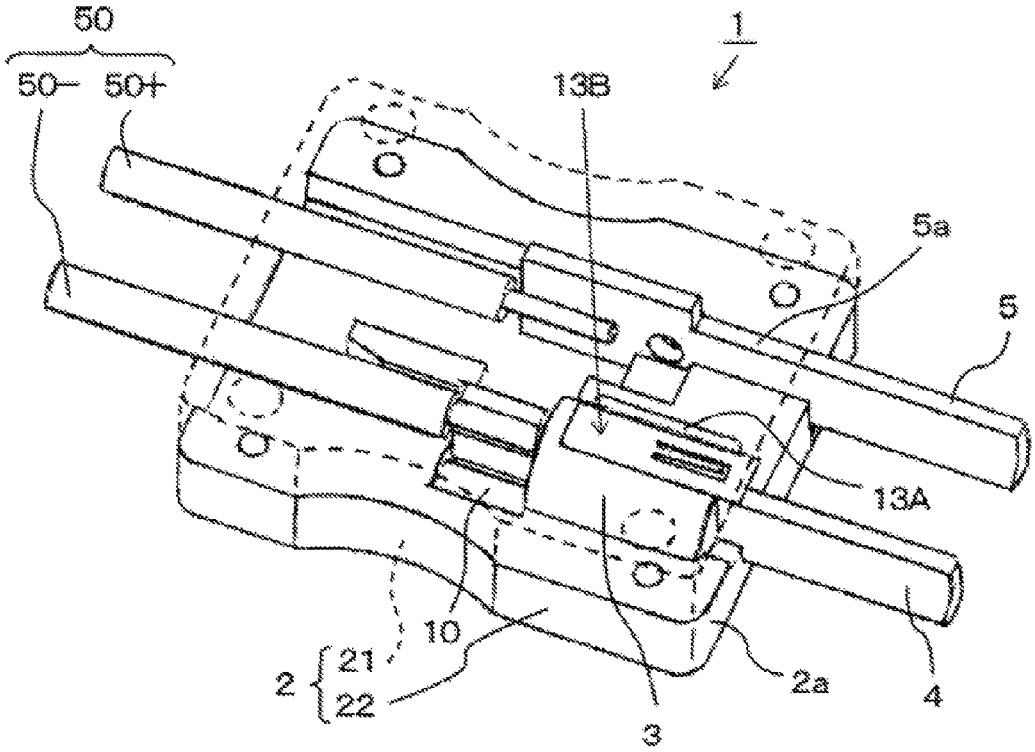
FIG. 1 is a perspective view showing an insertion plug 1 according to one embodiment of the present invention with a top cover 21 being omitted.

Hereinafter, an insertion plug 1 according to one embodiment of the present invention is explained with reference to FIG. 1 to FIG. 6. As shown in FIG. 1, the insertion plug 1 according to the present embodiment is connected to terminals of a pair of DC power source cords 50, and supplies electric power from a commercial use DC power source to an appliance (not illustrated in the figures) connected to the other side of the DC power source cords 50. A pair of blades 4, 5 that are to be inserted to an outlet (not illustrated in the figures) projects from a connection surface 2*a* of an insulative plug case 2. Hereinafter, in the present specification, respective portions are explained with reference to a forward direction and upward, downward, leftward and rightward directions. The forward direction is the direction in which the pair of blades 4, 5 projects; and the upward, downward, leftward and rightward directions are the upward, downward, leftward and rightward directions relative to the connection surface 2*a* as seen from the forward direction in FIG. 1.

The pair of blades 4, 5 are respectively formed into elongated plate-like shapes from conductive metallic plates. To inner side surfaces of rear end portions of the pair of blades 4, 5 are solder-connected, in each plug case 2, core wires of a high voltage-side DC power source cord 50+ to which a DC voltage is applied and a ground-side DC power source cord 50− at a ground potential. The one blade (hereinafter, called the movable blade) 4 connected to the ground-side DC power source cord 50− is positioned freely revolvably relative to the plug case 2. The other blade (hereinafter, called the fixed blade) 5 connected to the high voltage-side DC power source cord 50+ is fixed to the plug case 2 with an intermediate attaching portion 5*a* being positioned in a square hole 7 formed by a top cover 21 and a lower cover 22 being coupled with each other.

Figure 2:
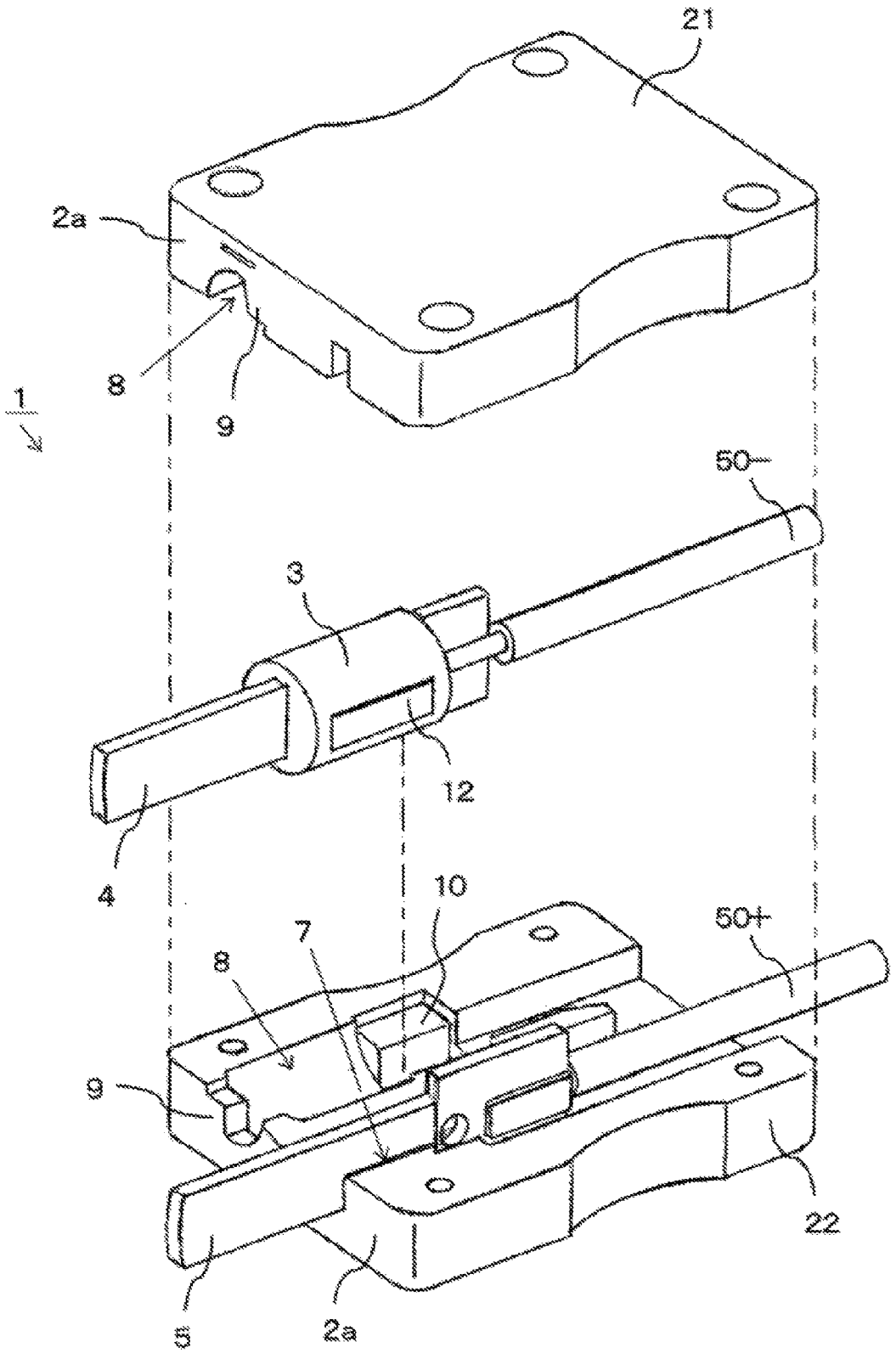
FIG. 2 is an exploded perspective view of the insertion plug 1.

As shown in FIG. 2, a cylindrical rotor 3 made of insulative plastic is integrally molded and fixed around an intermediate attaching portion of the movable blade 4. The rotor 3 freely fits in a cylindrical hole 8 formed by the top cover 21 and the lower cover 22 being coupled to each other. The circumferential surface of the rotor 3 is formed into a cylindrical shape formed around the central axis along front and rear directions of the movable blade 4 integral with and penetrating the rotor 3. The inner side surface of the cylindrical hole 8 is formed coaxially with and around the circumferential surface of the rotor 3. Accordingly, the cylindrical hole 8 guides the rotor 3 and the movable blade 4 freely revolvably around the central axis.

On the other hand, on the lower left side and the upper right side of an opening portion at which the cylindrical hole 8 opens on the connection surface 2*a*, a pair of stopper projection portions 9 is provided to project from the lower cover 22 and the top cover 21, and a horizontal step portion 10 and a vertical wall portion 11 are integrally formed with the lower cover 22 and the top cover 21, respectively, within a revolution range in which the rear end portion of the movable blade 4 revolves. Accordingly, the movable blade 4 freely revolvable around the central axis is regulated to revolve within a rotation angle range of 90 degrees between a first rotation position at which the movable blade 4, when rotating clockwise, abuts on either a vertical surface of the stopper projection portion 9 or the vertical wall portion 11, and a second rotation position at which the movable blade 4, when rotating counterclockwise, abuts on either a horizontal surface of the stopper projection portion 9 and the horizontal step portion 10.

Figure 3:
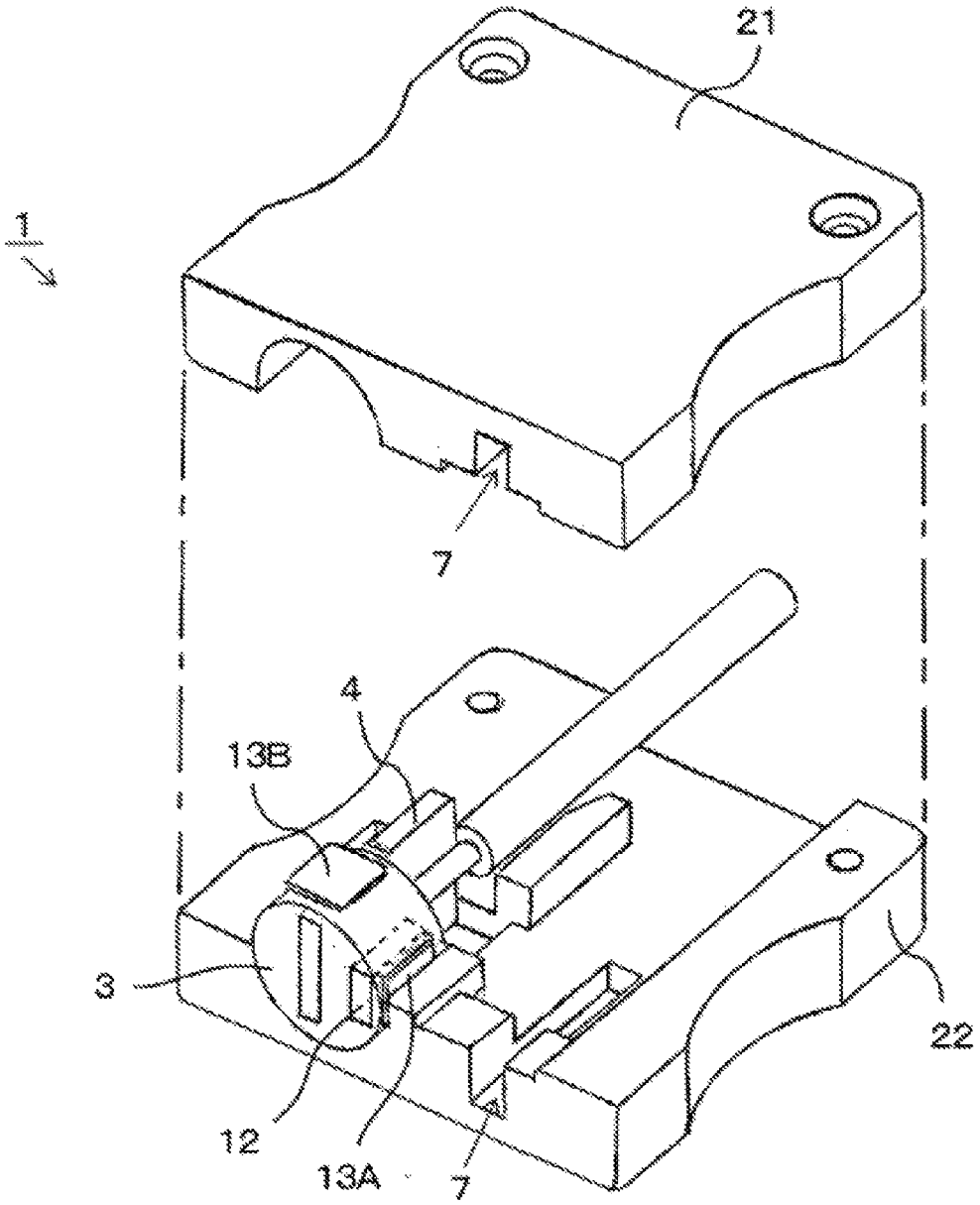
FIG. 3 is a vertical cross-sectional view showing a vertical cross-sectional surface of the insertion plug 1 cut off at the rotor 3 at a first rotation position with the top cover 21 being disassembled.
Figure 4:
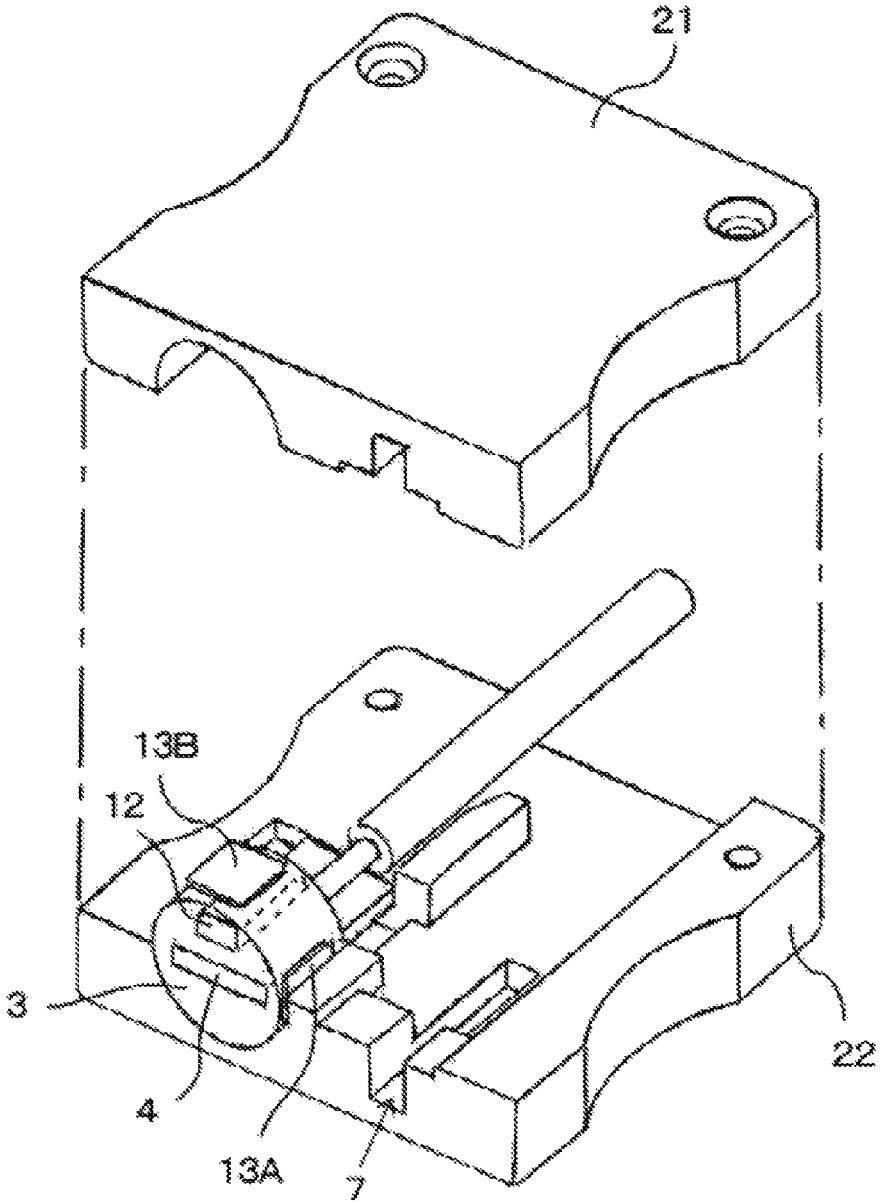
FIG. 4 is a vertical cross-sectional view showing a vertical cross-sectional surface of the insertion plug 1 cut off at the rotor 3 at a second rotation position with the top cover 21 being disassembled.
Figure 5:
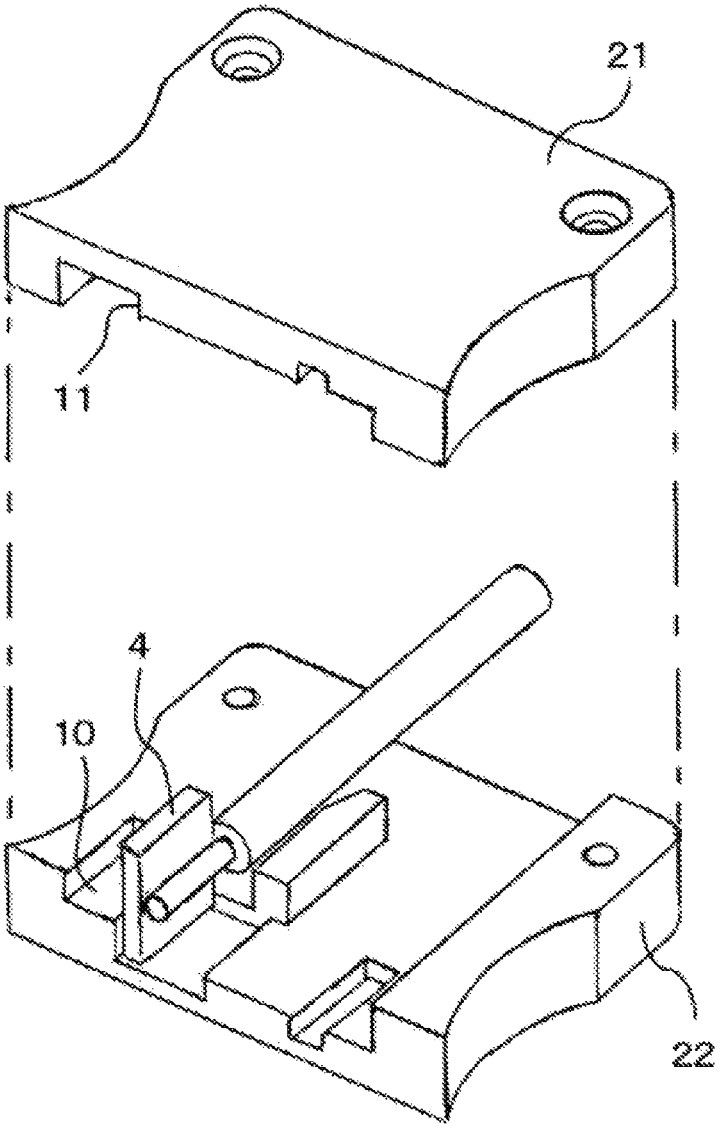
FIG. 5 is a vertical cross-sectional view showing a vertical cross-sectional surface of the insertion plug 1 cut off at a rear end portion of one blade 4 in a state where the rotor 3 is at the first rotation position, with the top cover 21 being disassembled.
Figure 6:
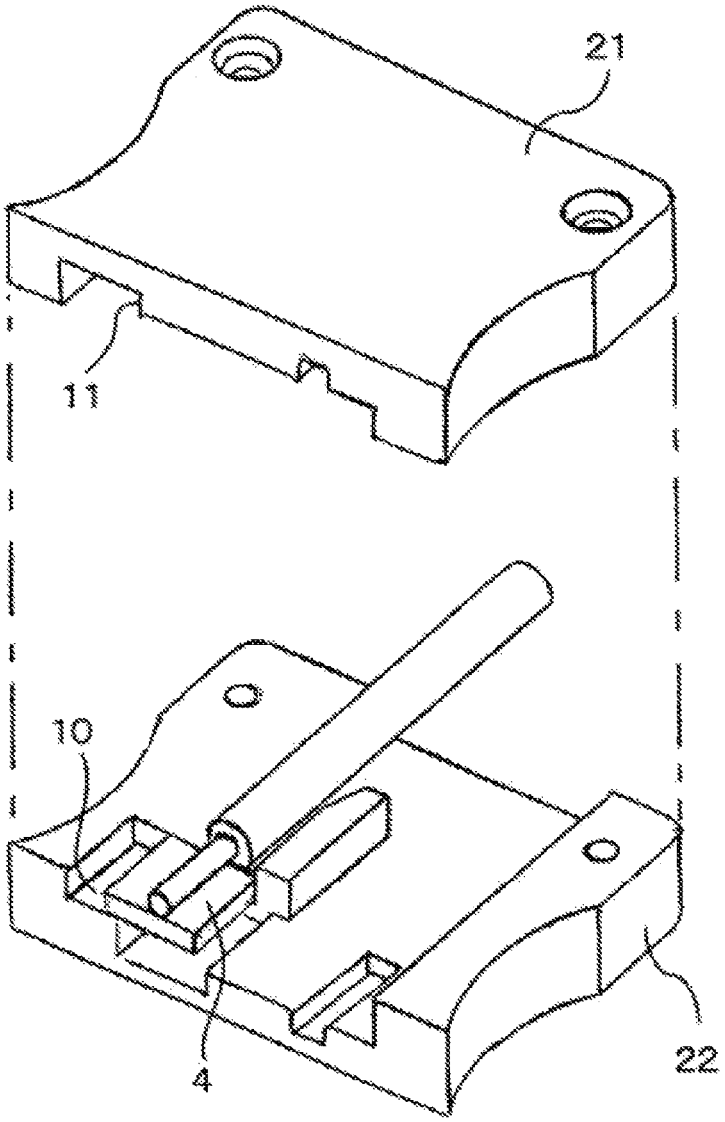
FIG. 6 is a vertical cross-sectional view showing a vertical cross-sectional surface of the insertion plug 1 cut off at a rear end portion of one blade 4 in a state where the rotor 3 is at the second rotation position, with the top cover 21 being disassembled.

A permanent magnet 12 which is a ferromagnetic body is embedded at any position in the circumferential surface of the rotor 3 at the time of formation of the rotor 3, and thin iron plates 13A, 13B that are ferromagnetic bodies to be attracted by the permanent magnet 12 are fixedly attached to the inner wall surface of the cylindrical hole 8 at positions to face the permanent magnet 12 if the rotor 3 is at the first rotation position and the second rotation position. For example, as shown in FIG. 3, in the present embodiment, because the permanent magnet 12 is embedded on the right side of the rotor 3, if the rotor 3 is at the first rotation position, the thin iron plate 13A facing the permanent magnet 12 at the first rotation position is attached to the right-side inner wall surface of the cylindrical hole 8 of the lower cover 22, and the thin iron plate 13B facing the permanent magnet 12 at the second rotation position is attached to the upper-side inner wall surface of the cylindrical hole 8 of the top cover 22.

The permanent magnet 12 and the thin iron plates 13A, 13B respectively serve as positioning units to position the rotor 3 at the first rotation position and the second rotation position. The attraction force between the permanent magnet 12 and the thin iron plate 13A that is at its maximum at the first rotation position where the distance between them becomes shortest positions the rotor 3 at the first rotation position, and the attraction force between the permanent magnet 12 and the thin iron plate 13B that is at its maximum at the second rotation position where the distance between them becomes shortest positions the rotor 3 at the second rotation position. Thereby, even if the ground-side DC power source cord 50− soldered with the movable blade 4 that revolves due to revolution of the rotor 3 is twisted, and a torque is generated, to the rotor 3, in a direction to reverse the twist, or an external force is applied unintentionally to the movable blade 4 that projects from the connection surface 2*a*, the first rotation position or the second rotation position is maintained, and the movable blade 4 does not revolve.

If the permanent magnet 12 and the thin iron plates 13A, 13B are in a relationship to attract each other, a ferromagnetic body such as a thin iron plate may be provided at a predetermined position on the rotor 3 side, and ferromagnetic bodies such as permanent magnets may be provided at predetermined positions on the plug case 2 side within the cylindrical hole 8. Also, because the ferromagnetic body arranged on the rotor 3 side and the ferromagnetic bodies arranged on the plug case 2 side within the cylindrical hole 8 only have to be at positions to face each other where the distances between them become shortest at the first rotation position and the second rotation position of the rotor 3, they may be attached at locations where they can be attached easily and that are different from those in the present embodiment.

When manufacturing the thus-configured insertion plug 1, the rotor 3 in which the permanent magnet 12 is embedded is integrally molded around the movable blade 4 at an intermediate position thereof, while setting aside a part thereof that projects in the forward direction from the connection surface 2*a*. Also, the thin iron plate 13A and the thin iron plate 13B are attached to areas of the lower cover 22 and the top cover 21 around the cylindrical hole 8 at which they respectively face the permanent magnet 12 at the first rotation position and the second rotation position of the rotor 3.

Thereafter, the fixed blade 5 and the movable blade 4 rear end portions of which are solder-connected to core wires of the high voltage-side DC power source cord 50+ and the ground-side DC power source cord 50− are housed with the attaching portion 5*a* of the fixed blade 5 in the square hole 7, and the rotor 3 of the movable blade 4 in the cylindrical hole 8 at the first rotation position, and respectively are attached along the front and rear directions on the lower cover 22. The top cover 21 to cover the entire structure is screwed to the lower cover 22, and the assembly completes.

Figure 7:
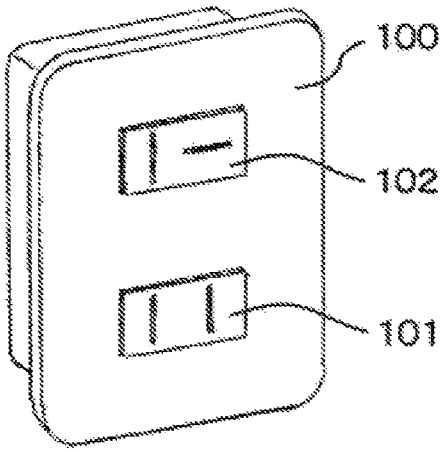
(RELATED ART) FIG. 7
FIG. 7 is a perspective view showing a conventional complex outlet 100.

In the assembled state, as shown in FIG. 1, the fixed blade 5 and the movable blade 4 are attached to the plug case 2 with their width directions oriented in the vertical direction, project from the connection surface 2*a* in the forward direction in parallel with each other while being distanced from each other by a predetermined interval, and forms a shape freely insertable to the AC power source outlet 101 shown in FIG. 7.

Also, because the movable blade 4 is attached to the plug case 2 freely revolvably around an axis extending in the front and rear directions, one can hold the part of the movable blade 4 that projects from the connection surface 2*a* in the forward direction to rotate the movable blade 4 by 90 degrees counterclockwise from the first rotation position to the second rotation position at which the movable blade 4 abuts on either a horizontal surface of the stopper projection portion 9 or the horizontal step portion 10 against the attraction force acting between the permanent magnet 12 and the thin iron plate 13A. Because at the second rotation position, the distance between the permanent magnet 12 and the thin iron plate 13B is at its minimum, and the attraction force is at its maximum, the movable blade 4 fixed to the rotor 3 is positioned at the second rotation position where its width direction gets oriented in the horizontal direction.

Because in a state where the rotor 3 is positioned at the second rotation position, the movable blade 4 projects from the connection surface 2*a* of the plug case 2 in the forward direction while being orthogonal to the fixed blade 5 having a width direction in the vertical direction, it forms a shape freely insertable to the DC power source outlet 102 shown in FIG. 7.

Similarly, because the rotor 3 can be rotated clockwise from the second rotation position to the first rotation position against the attraction force acting between the permanent magnet 12 and the thin iron plate 13B, the movable blade 4 may be caused to project in parallel with the fixed blade 5, and the shape may reverted to be freely insertable to the AC power source outlet 101.

Accordingly, even if power distribution in a house or a building is switched to be performed by DC electric supply using the conventional AC power source outlet 101 embedded into a wall or the like as a power source outlet for DC electric supply, the insertion plug 1 in which the rotor 3 is at the first rotation position is inserted thereinto, and a load connected to the power source cord 50 can be allowed to operate with a DC power source without requiring replacement of the AC power source outlet 101. Also, even after the AC power source outlet 101 is replaced with the DC power source outlet 102, the insertion plug 1 connected to the load side can be inserted thereinto without making any change, and the load can operate with a DC power source.

Although in the above-mentioned embodiment, the rotor 3 is positioned at the first rotation position and the second rotation position by the attraction forces acting between the permanent magnet 12 and the thin iron plates 13A, 13B, a detent configured with projections and depressions that can be climbed over may be provided between an outer side surface of the rotor 3 and an inner wall surface of the cylindrical hole 8 as long as such a detent allows one to revolve the movable blade 4 between the first rotation position and the second rotation position manually.

Also, the positioning unit may be a fixing unit that fixes revolution of the rotor 3 at the first rotation position and the second rotation position, and a release unit that releases respective fixation. For example, a locking pin or a screw may be caused to project from the plug case 2 side into the rotor 3 at the first rotation position and the second rotation position, and the locking pin or the screw may be drawn out of the rotor 3 if the rotor 3 is to be revolved.

Also, although in the above-mentioned embodiment, the rotor 3 is revolved around an axis by 90 degrees to position the rotor 3 at the first rotation position and the second rotation position, it may be rotated by 270 degrees to position the rotor 3 at the first rotation position and the second rotation position.

Furthermore, although the movable blade 4 is connected to the ground-side power source cord 10− of a DC power source cord, if there is no risk of electric shocks before inserting the insertion plug 1 into a power source outlet, the movable blade 4 may be connected to the high voltage-side power source cord 10+.

Furthermore, the insertion plug 1 is not limited to a 2-pole plug having a pair of blades projecting therefrom, but may be a 3-pole plug having an additional earth electrode blade projecting therefrom.

INDUSTRIAL APPLICABILITY

Embodiments of the present invention are suited to an insertion plug that is freely insertable to both a DC power source outlet and an AC power source outlet.

EXPLANATION OF REFERENCE SYMBOLS

1: insertion plug
2: plug case
2*a*: connection surface
3: rotor
4: one blade (movable blade)
5; the other blade (fixed blade)
8: cylindrical hole (guide unit)
12: first ferromagnetic body (permanent magnet)
13A: second ferromagnetic body (thin iron plate)
13B: second ferromagnetic body (thin iron plate)
50: power source cord
50−: ground-side power source cord

What is claimed is:

1. An insertion plug with at least a pair of one blade and another blade to connect to a terminal of a power source cord; project from a connection surface of an insulating plug case; and be inserted to an outlet connected to a power source, thereby establishing a connection between the power source cord and the power source, the insertion plug comprising:

a rotor fixed around the one blade, and housed freely revolvably in the insulating plug case;

a guide unit that is provided in the insulating plug case; and guides the rotor freely revolvably around an axis that extends in a longitudinal direction of the one blade and within a rotation angle of at least 90 degrees or larger between a first rotation position at which the one blade becomes substantially parallel with the other blade and a second rotation position at which the one blade becomes substantially orthogonal to the other blade; and a positioning unit that positions, at the first rotation position or the second rotation position, the rotor that revolves between the first rotation position and the second rotation position, wherein if the rotor is positioned at the first rotation position, the one blade and the other blade are caused to project from a position of the connection surface at which the one blade and the other blade are freely insertable to an AC power source outlet to connect to a commercial use AC power source, and if the rotor is positioned at the second rotation position, the one blade and the other blade are caused to project from a position of the connection surface at which the one blade and the other blade are freely insertable to a DC power source outlet to connect to a commercial use DC power source.

2. The insertion plug according to claim 1, wherein the one blade is connected to a ground-side power source cord.

3. The insertion plug according to claim 1, wherein the positioning unit has:

a first ferromagnetic body fixed to an outer side surface of the rotor; and a second ferromagnetic body that is fixed to the guide unit in an area facing the first ferromagnetic body between the first rotation position and the second rotation position of the rotor, and is attracted by the first ferromagnetic body.

4. The insertion plug according to claim 1, wherein the positioning unit has:

a fixing unit that fixes revolution of the rotor selectively at either the first rotation position or the second rotation position; and a release unit that releases the fixation by the fixing unit.

* * * * *